US006176815B1

(12) United States Patent
Riera

(10) Patent No.: US 6,176,815 B1
(45) Date of Patent: Jan. 23, 2001

(54) SWIMMING EXERCISE AND TRAINING APPARATUS

(76) Inventor: Leonardo Alberto Riera, 18705 Sea Turtle La., Boca Raton, FL (US) 33498

( * ) Notice: Under 35 U.S.C. 154(b), the term of this patent shall be extended for 0 days.

(21) Appl. No.: 09/241,189

(22) Filed: Feb. 1, 1999

(51) Int. Cl.[7] ..... A63B 31/00
(52) U.S. Cl. ..... 482/55; 441/117
(58) Field of Search ..... 482/23, 55, 91; 473/474; 441/117

(56) References Cited

U.S. PATENT DOCUMENTS

| | | | | |
|---|---|---|---|---|
| 4,247,096 | * | 1/1981 | Schmitt | 272/71 |
| 4,519,783 | * | 5/1985 | Burke | 482/55 |
| 4,551,108 | * | 11/1985 | Bass | 482/55 |
| 5,601,514 | * | 2/1997 | Horn | 482/55 |
| 5,630,589 | * | 5/1997 | Adie | 473/474 |
| 5,832,672 | * | 11/1998 | Griffiths | 52/4 |

* cited by examiner

*Primary Examiner*—Michael A. Brown
(74) *Attorney, Agent, or Firm*—Oltman, Flynn & Kubler

(57) ABSTRACT

A swimming exercise and training apparatus having a flotation member constructed of a generally lightweight, semi-rigid, buoyant material and sized and shaped so that it may be positioned against a portion of a person's upper torso, a plurality of straps structured to removably secure the flotation member to the person's upper torso and a pair of cords structured to retain the flotation member, and consequently, the swimmer wearing the flotation member, substantially in place. Each cord includes a first end attached to the flotation member and an opposite second end attached to a suction cup or a stake member having a generally flat horizontal surface on its upper portion and a hook on its lower portion. A resistance varying mechanism, in which a single cord extends through the flotation member, around a first pulley at a first end of the flotation member, back into the flotation member and onto a second take-up pulley within the flotation member and a tension rod exerts variable resistance on the cord, may also be included for exercise purposes.

17 Claims, 9 Drawing Sheets

SWIMMING EXERCISE AND TRAINING APPARATUS

BACKGROUND OF THE INVENTION

1. Field of the Invention

The present invention relates to swimming devices and, more particularly, to an exercise and training apparatus for swimmers.

2. Description of the Related Art

The importance of teaching people to swim cannot be understated. The number of deaths due to drowning continues to rise year after year. Thus, people are always in search of suitable devices to assist with the process of learning to swim.

Several devices have been developed to address this need. Most simply consist of some sort of flotation device, such as circular bands for insertion around a person's arms or waist, a vest worn around a person's upper torso or a board for the person to lean on.

Although somewhat useful for their intended purpose, these prior art devices have not proven to be entirely satisfactory. Specifically, it may be preferable for a person to learn the mechanics of swimming by remaining in a stationary position. Also, means for tethering the swimmer to the side of the pool or to the shore may be desirable to facilitate the swimmers exit or retrieval during an emergency. Moreover, if learning to swim in an ocean, lake or other moving body of water, maintaining the swimmer in a stationary position and tethered to the shore may be vital. It is not uncommon for swimmers to be swept out into deeper waters by the tide or undercurrent. This could pose a great danger to beginning or novice swimmers.

Swimming has also become a common means of exercise for many people. In addition to the muscular activity, it is widely recognized that swimming is good for the cardiovascular system. For such purposes, people generally swim several laps. However, swimming laps typically requires a large pool, which is not always available. Even when such a large pool is available, swimming laps may not be feasible if the pool is crowded.

Accordingly, there is still a need in the art for an apparatus which enables a person to safely learn to swim while being maintained in a stationary position. Any such device should include means for tethering the swimmer to the side of the pool or to the shore so that the swimmer could pull himself to safety or be pulled to safety by others. Any such device should also be capable of use by swimmers as a means for exercise. The present invention is particularly suited to overcome those problems which remain in the art in a manner not previously known.

SUMMARY OF THE INVENTION

The present invention is directed towards a new and improved swimming exercise and training apparatus comprising a flotation member constructed of a generally lightweight, semi-rigid, buoyant material and sized and shaped so that it may be positioned against a portion of a person's upper torso, a plurality of straps structured to removably secure the flotation member to the person's upper torso and a pair of cords structured to retain the flotation member, and consequently, the swimmer wearing the flotation member, substantially in place. Each cord includes a first end attached to the flotation member and an opposite second end attached to a suction cup, structured for removable attachment to a generally flat stationary surface, such as the wall in or deck surrounding a swimming pool, or a stake-like member structured for removable insertion into the sand or ground adjacent an ocean, lake or other body of water. Each stake-like member includes a generally flat horizontal surface on its upper portion, to facilitate pushing the stake-like member into the sand or ground, and a hook on its lower portion to facilitate attachment to ragged surfaces, such as rocks, trees, etc. A swivel, attached to the second end of the cord, may be secured to the upper portion of the stake-like members to allow the cord to pivot around the stake-like member in a generally horizontal plane. A resistance varying mechanism, in which a single cord extends through the flotation member, around a first pulley at a first end of the flotation member, back into the flotation member and onto a second take-up pulley within the flotation member and a tension rod exerts variable resistance on the cord, may also be included for exercise purposes.

It is an object of the present invention to provide a new and swimming training apparatus which has all the advantages of the prior art devices and none of the disadvantages.

It is another object of the present invention to provide such an apparatus which maintains the swimmer in a generally stationary position.

It is also an object of the present invention to provide such an apparatus which includes means for tethering the swimmer to the side of the pool or to the shore.

It is a further object of the present invention to provide such an apparatus which is capable of use by swimmers as a means for exercise.

It is yet another object of the present invention to provide such an apparatus which includes means for varying the resistance against which the swimmer is swimming.

These and other objects and advantages of the present invention will become more readily apparent in the description which follows.

BRIEF DESCRIPTION OF THE DRAWINGS

For a fuller understanding of the nature of the present invention, reference should be had to the following detailed description, taken in connection with the accompanying drawings in which.

Like reference numerals refer to like parts throughout the several views of the drawings.

DETAILED DESCRIPTION OF THE PREFERRED EMBODIMENT

Figure 1:
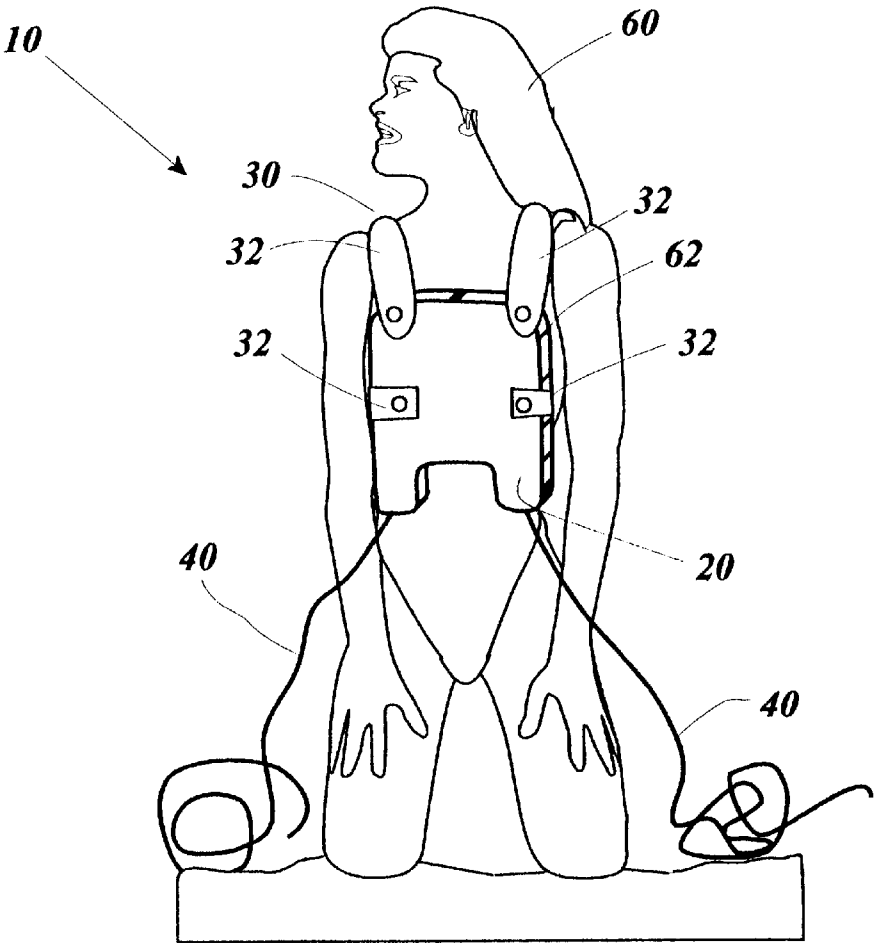
FIG. 1 is a front plan view of the swimming exercise and training apparatus secured to a person's upper torso.
Figure 2:
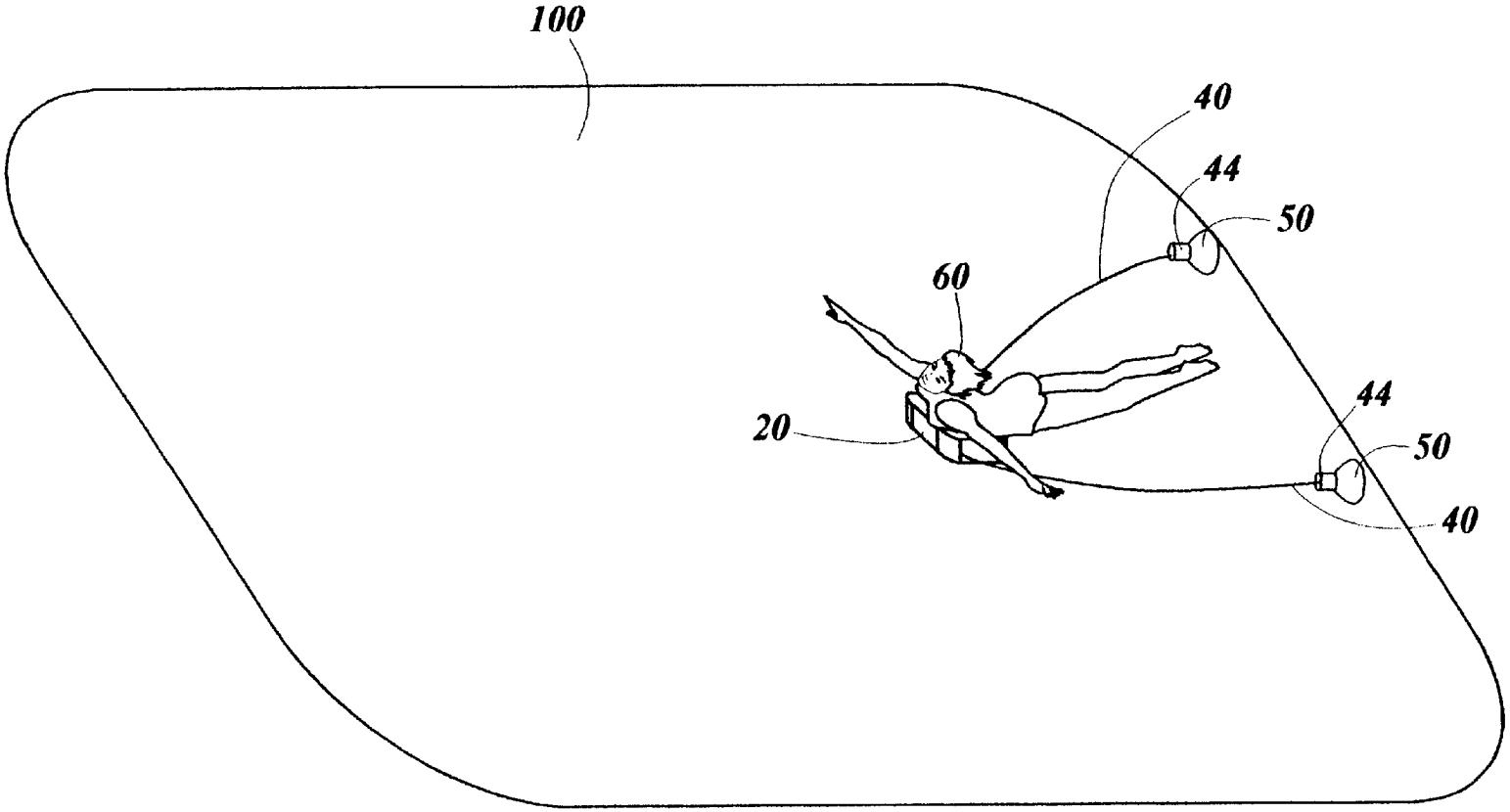
FIG. 2 is a perspective view of a swimmer wearing the swimming exercise and training apparatus with the cords attached to suction cups secured to a swimming pool wall.
Figure 3:
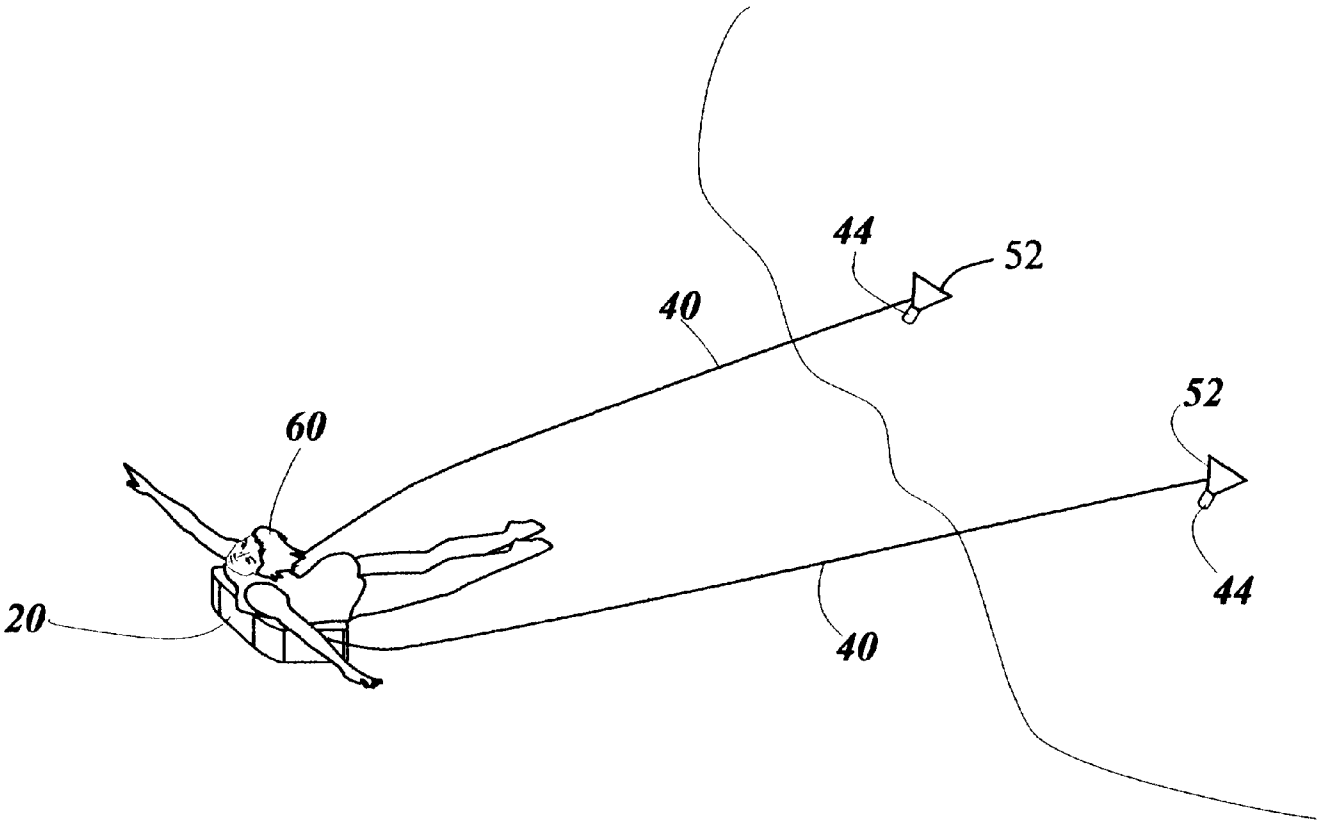
FIG. 3 is a perspective view of a swimmer wearing the swimming exercise and training apparatus with the cords attached to stake-like members secured to the ground.
Figure 4:
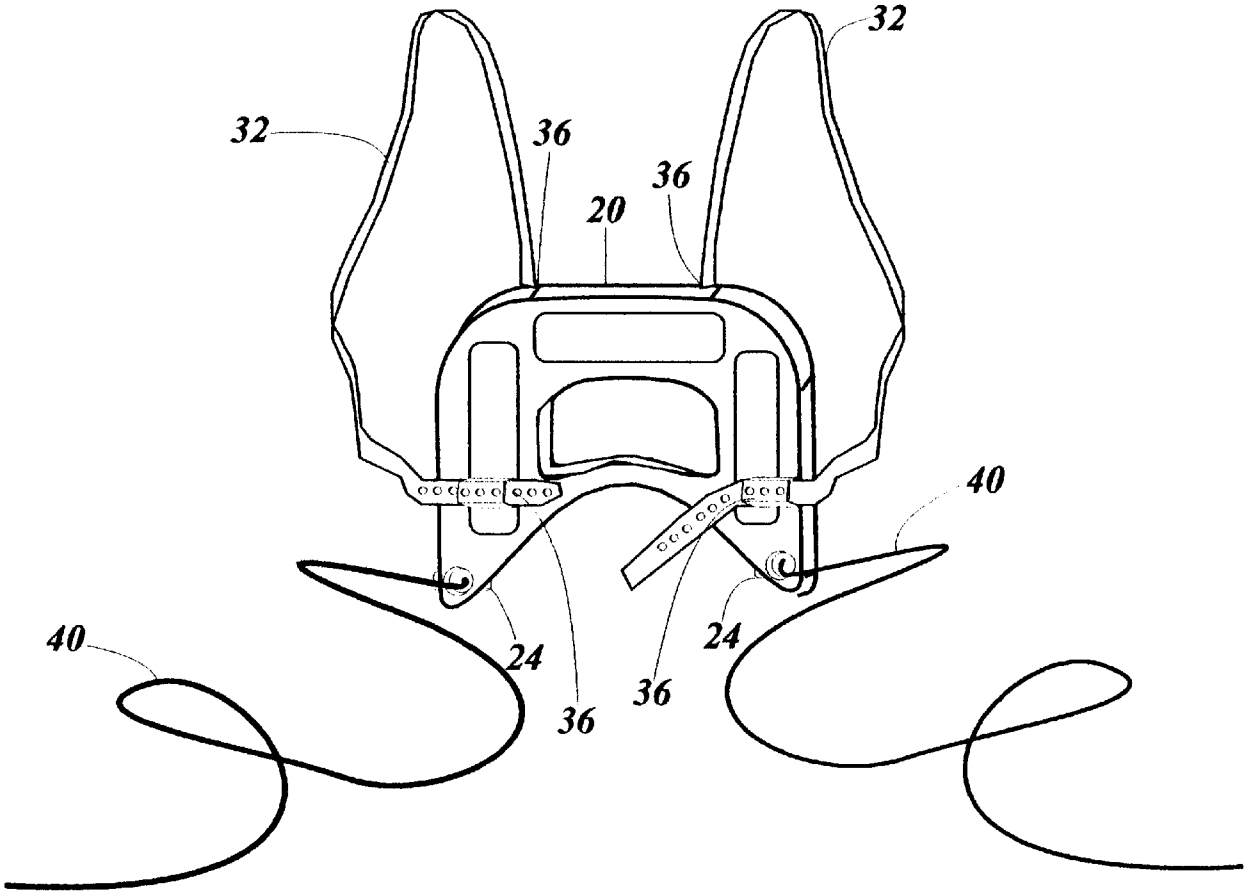
FIG. 4 is a perspective view of the swimming exercise and training apparatus.
Figure 5:
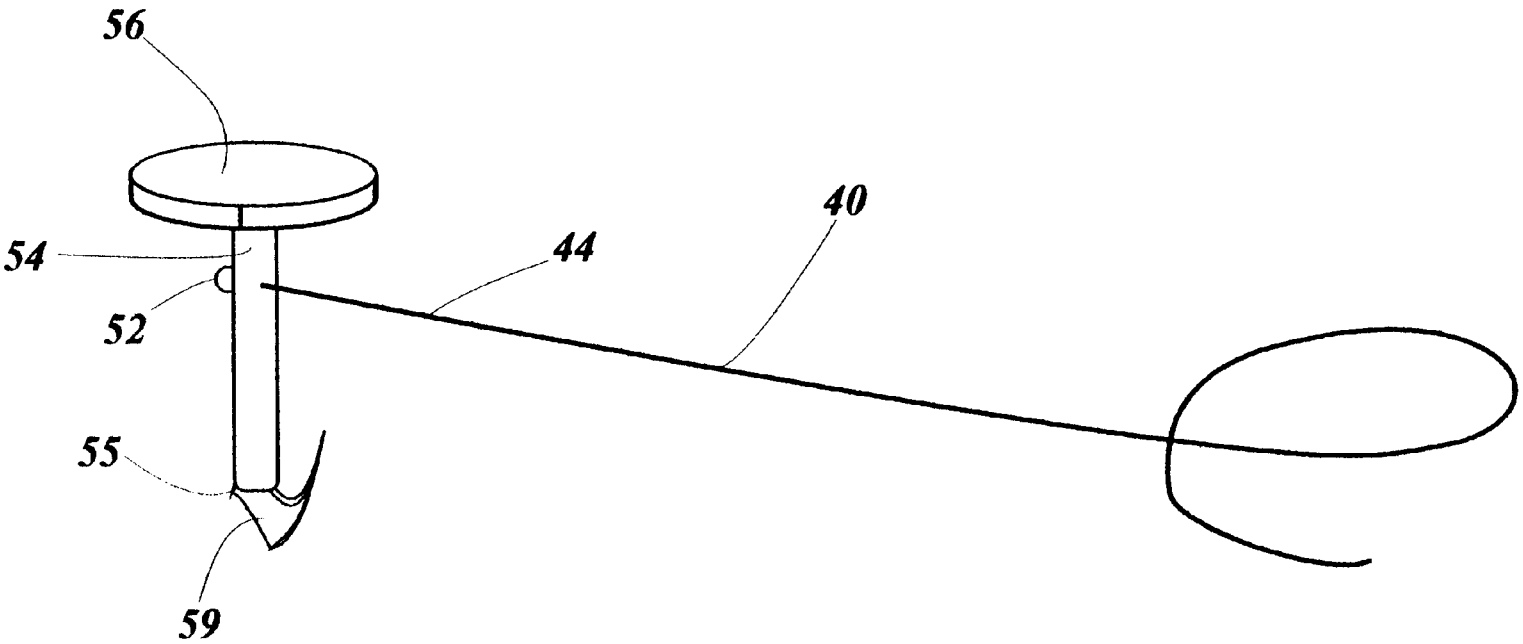
FIG. 5 is a perspective view of a stake-like member.
Figure 6:
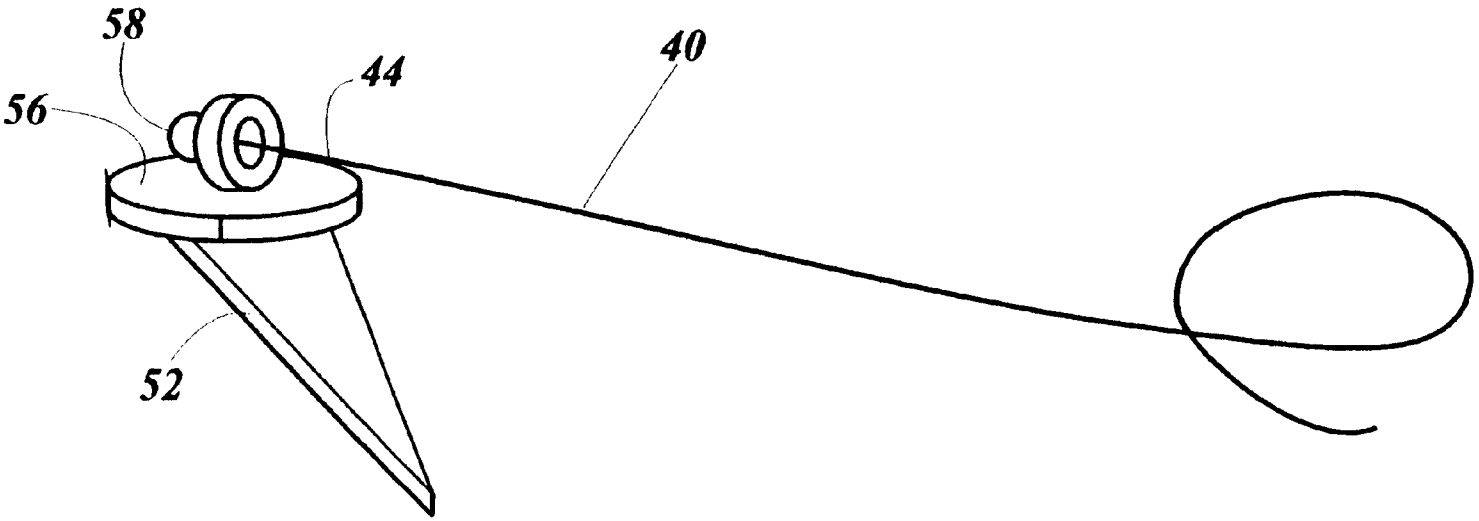
FIG. 6 is a perspective view of a stake-like member with a swivel.

Before explaining the disclosed embodiment of the present invention in detail, it is to be understood that the invention is not limited in its application to the details of the particular arrangement shown since the invention is capable of other embodiments. Also, the terminology used herein is for the purpose of description and not of limitation.

As shown in FIGS. 1–9, the present invention is directed towards a new and improved swimming exercise and training apparatus 10 comprising a flotation member 20, a plurality of straps 30, and a pair of cords 40. The flotation member 20 is constructed of a generally lightweight, semi-rigid, buoyant material, such as polyurethane foam, which is capable of floating on the surface of a body of water with the weight of a person 60 thereon. The flotation member 20 is sized and shaped so that it may be positioned against a portion of the upper torso 62 of the person 60.

The straps 30 are structured to removably secure the flotation member 20 to the person's upper torso 62. In the preferred embodiment, the apparatus 10 includes a pair of straps 32 structured to extend over the swimmer's shoulders and back under the swimmer's arms. Each strap 30 includes opposite ends 36 structured for attachment to the flotation member 20. Any suitable attachment means known in the art, such as snaps, buckles, velcro, etc., may be utilized. Other combinations of straps 30 may, alternatively, be used to secure the flotation member 20 to the person's upper torso 62.

The cords 40 are structured to retain the flotation member 20, and consequently, the swimmer wearing the flotation member 20, substantially in place. Each cord 40 includes a first end 42 attached to the flotation member 20 and an opposite second end 44 structured for attachment to a generally stationary object. The first end 42 of each cord 40 is preferably removably attached to opposite lower side portions 24 of the flotation member 20. However, the cords 40 may, alternatively, be attached to other suitable portions of the flotation member 20. Likewise, the number of cords 40 may vary as necessary to accommodate the particular means of using the exercise and training apparatus 10. The cords 40 may be constructed of any suitable resilient or non-resilient material.

Figure 7:
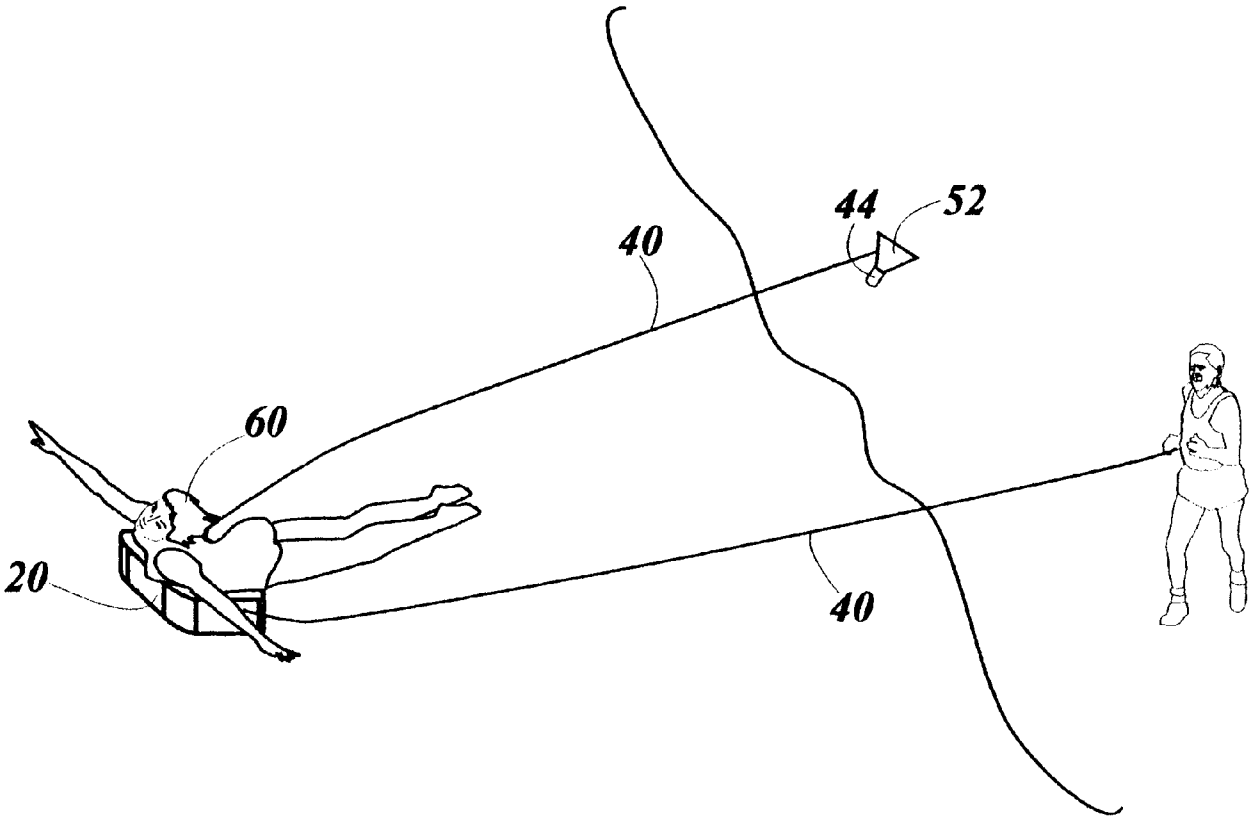
FIG. 7 is a perspective view of a swimmer wearing the swimming exercise and training apparatus with one cord attached to a stake-like member secured to the ground and a second cord held by an other person.

The second end 44 of each cord 40 may be attached to a suction cup 50 structured for removable attachment to a generally flat stationary surface, such as the wall 102 in or deck surrounding 104 a swimming pool 100, or a stake-like member 52 structured for removable insertion into the sand or ground adjacent an ocean, lake or other body of water. Each stake-like member 52 includes an upper portion 54 with a generally flat, horizontal surface 56 structured to facilitate the users exertion of force thereon to push the stake-like member 52 into the sand or ground. A hook 59 may also be provided on the lower portion 55 of the stake-like member 52 to facilitate attachment to ragged surfaces, such as rocks, trees, etc. As shown in FIG. 7, the second end 44 of one or more of the cords 40 may alternatively be held by another person to control the flow of the cord 40, as well as the swimmer's 60 distance from the side of the swimming pool 100 or shore.

A swivel 58 may be secured to the upper portion 54 of the stake-like members 52 and attached to the second end 44 of a cord 40 to allow the cord 40 to pivot around the stake-like member 52 in a generally horizontal plane. The swivel 58 will facilitate the swimmers 60 ability to move from side to side without straining the attachment of the second end 44 of a cord 40 to the stake-like member 52 and loosening the attachment of the stake-like member 52 in the sand or ground.

Figure 8:
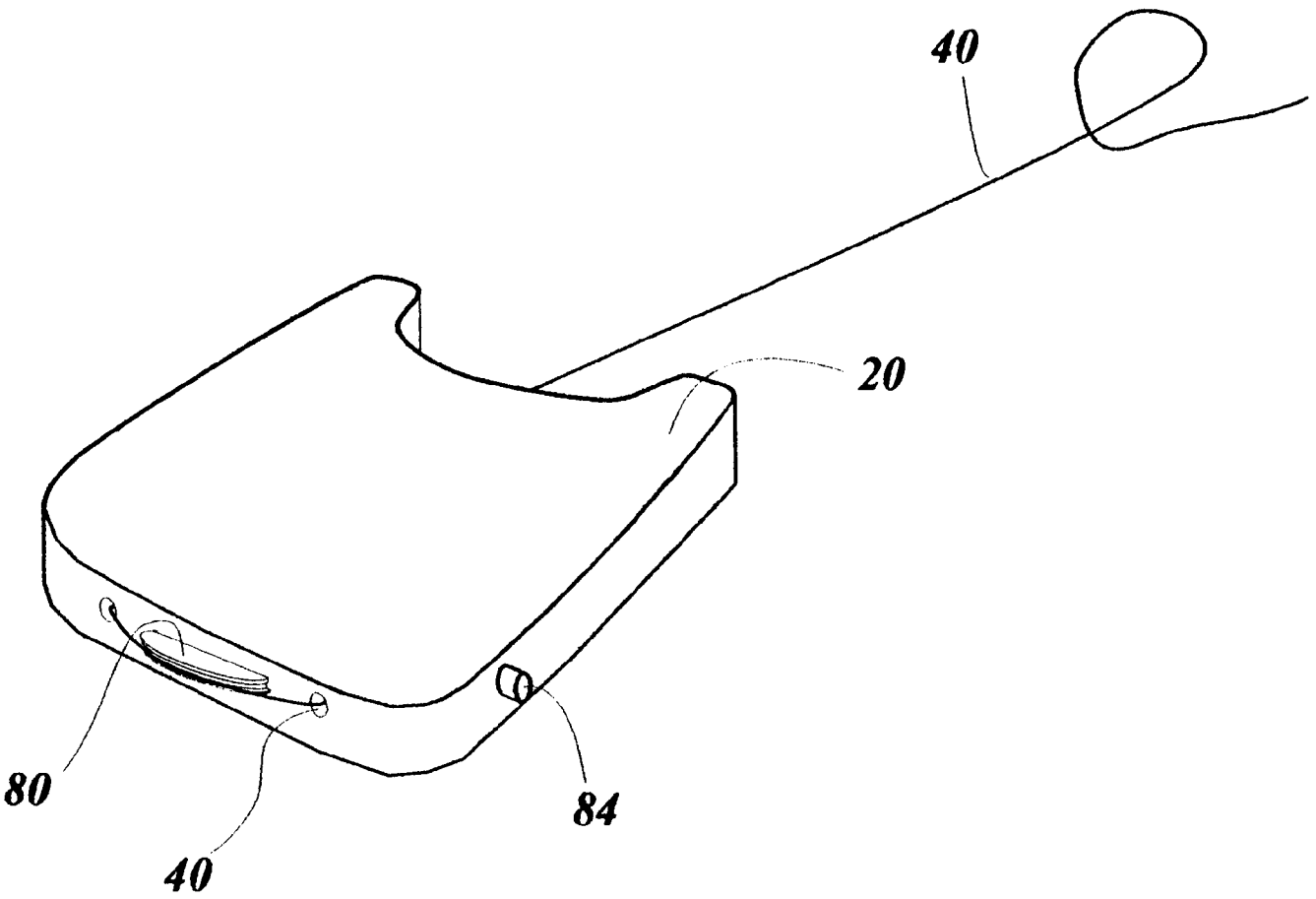
FIG. 8 is a perspective view of a flotation member having a resistance varying mechanism.
Figure 9:
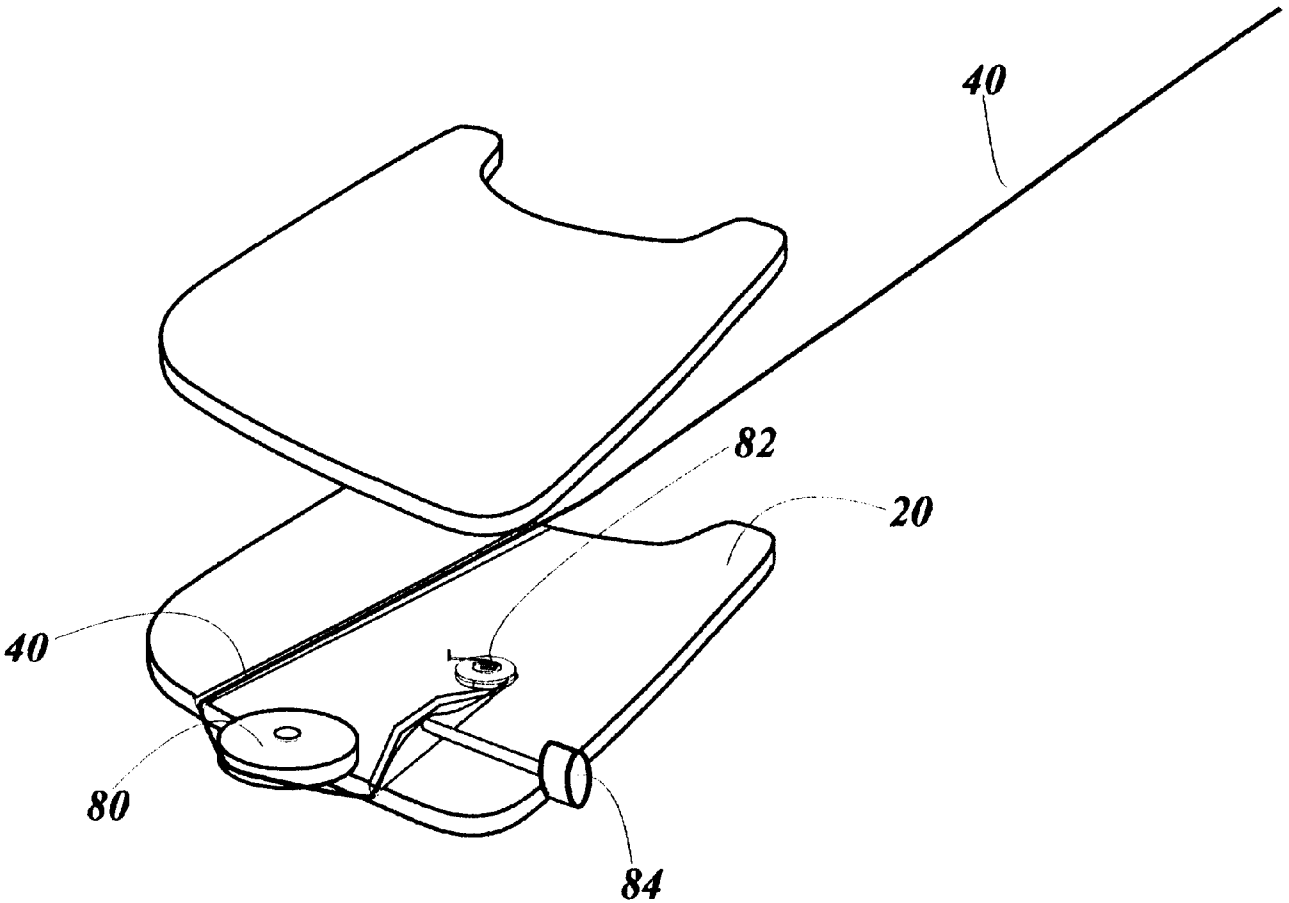
FIG. 9 is a perspective view of the inside of a flotation member showing the resistance varying mechanism.

Referring now to FIGS. 8 and 9, a resistance varying mechanism may also be included in the apparatus 10 for exercise purposes. Such mechanism includes a first pulley 80 at a first end 28 of the flotation member 20, a second take-up pulley 82 within the flotation member 20 and a tension rod 84 disposed between the first pulley 80 and the second take-up pulley 82. With this resistance varying mechanism, only one cord 40 is utilized. The cord 40 extends through the flotation member 20, around the first pulley 80, back into the flotation member 20 and onto the second take-up pulley 82. The tension rod 84 is structured for rotating movement between a first tensioned position whereby the tension rod 84 presses against the cord 40 and a second relaxed position whereby the tension rod 84 and cord 40 are not in contact with one another. In essence, the tension rod 84 varies the cord's 40 resistance to movement within the flotation member 20 by varying the friction applied to the cord 40 and the angle of feed onto the second take-up pulley 82. In use, the cord 40 is released from the second take-up pulley 82 and, correspondingly, the swimmer's distance from shore increases, as the swimmer 60 progresses. The rate at which the cord 40 will release from the second take-up pulley 82 is dependent upon the tension applied to the cord 40 by the tension rod 84.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended.

What is claimed is:

1. A swimming exercise and training apparatus comprising:

a flotation member sized and shaped to be positioned against a portion of a person's upper torso, said flotation member be constructed of a material capable of buoyantly resting on the surface of a body of water with said person thereon;

means for removably securing said flotation member to said portion of said person's upper torso;

means for retaining said flotation member substantially in place;

wherein said means for retaining said flotation member substantially in place comprises at least one cord having a first end attached to said flotation member and an opposite second end structured for attachment to a gel station object;

further comprising at least one stake member, each of said at least one stake members being attached to said second end of said at least one cord and being structured for removable attachment to a stationary surface;

wherein each of said at least one stake members includes an upper portion with a generally flat surface, said generally flat surface being structured to facilitate the exertion of force thereon so as to push said at least one stake member into said stationary surface; and further comprising a swivel secured to said upper portion of said at least one stake member and attached to said second end of said at least one cord, said swivel being structured to allow said at least one cord to pivot around said at least one stake member in a generally horizontal plane.

2. A swimming exercise and training apparatus as recited in claim 1 wherein said means for removably securing said flotation member to said portion of said person's upper torso comprises at least one strap structured to extend around said portion of said person's upper torso and having opposite ends structured for attachment to said flotation member.

3. A swimming exercise and training apparatus as recited in claim 1 further comprising at least one suction cup, each of said at least one suction cups being attached to said second end of said at least one cord and being structured for removable attachment to a stationary surface.

4. A swimming exercise and training apparatus as recited in claim 1 wherein each of said at least one stake-like members includes a lower portion with a hook, said hook being structured to engage ragged surfaces so as to secure said at least one stake-like member thereto.

5. A swimming exercise and training apparatus comprising:

a flotation member sized and shaped to be positioned against a portion of a person's for torso, said flotation member be constructed of a material capable of buoyantly resting on the surface of a body of water with said person thereon;

means for removably securing said flotation member to said portion of said person's upper torso;

means for retaining said flotation member substantially in place;

wherein said means for retaining said flotation member substantially in place comprises at least one cord having a first end attached to said flotation member and an opposite second end structured for attachment to a generally stationary object;

further comprising means for varying resistance on said at least one cord; and wherein said means for varying resistance on said at least one cord comprises a first pulley at a first end of said flotation member, a second take-up pulley within said flotation member and a tension rod disposed between said first pulley and said second take-up pulley, said at least one cord extending through said flotation member, around said first pulley and onto said second take-up pulley, said tension rod being structured for movement between a first tensioned position whereby said tension rod presses against said at least one cord and a second relaxed position whereby said tension rod and said at least one cord are not in contact with one another.

6. A swimming exercise and training apparatus comprising:

a flotation member sized and shaped to be positioned against a portion of a person's upper torso, said flotation member constructed of a material capable of buoyantly resting on the surface of a body of water with said person thereon;

means for removably securing said flotation member to said portion of said person's upper torso;

at least one cord having a first end attached to said flotation member and an opposite second end structured for attachment to a generally stationary object, said at least one cord being structured to retain said flotation member substantially in place;

further comprising at least one stake member, each of said at least one stake members being attached to said second end of said at least one cord and being structured for removable attachment to a stationary surface;

wherein each of said at least one stake members includes an upper portion with a generally flat surface, said generally flat surface being structured to facilitate the exertion of force thereon so as to push said at least one stake member into said stationary surface; and further comprising a swivel secured to said upper portion of said at least one stake member and attached to said second end of said at least one cord, said swivel being structured to allow said at least one cord to pivot around said at least one stake member in a generally horizontal plane.

7. A swimming exercise and training apparatus as recited in claim 6 wherein said means for removably securing said flotation member to said portion of said person's upper torso comprises at least one strap structured to extend around said portion of said person's upper torso and having opposite ends structured for attachment to said flotation member.

8. A swimming exercise and training apparatus as recited in claim 6 further comprising at least one suction cup, each of said at least one suction cups being attached to said second end of said at least one cord and being structured for removable attachment to a stationary surface.

9. A swimming exercise and training apparatus as recited in claim 6 wherein each of said at least one stake-like members includes a lower portion with a hook, said hook being structured to engage ragged surfaces so as to secure said at least one stake member thereto.

10. A swimming exercise and training apparatus comprising:

a flotation member sized and shaped to be positioned against a portion of a person's upper torso, said flotation member be constructed of a material capable of buoyantly resting on the surface of a body of water with said person thereon;

means for removably securing said flotation member to said portion of said person's upper torso;

at least one cord having a first end attached to said flotation member and an opposite second end structured for attachment to a generally stationary object, said at least one cord being structured to retain said flotation member substantially in place;

further comprising means for varying resistance on said at least one cord; and wherein said means for varying resistance on said at least one cord comprises a first pulley at a first end of said flotation member, a second take-up pulley within said flotation member and a tension rod disposed between said first pulley and said second take-up pulley, said at least one cord extending through said flotation member, around said first pulley and onto said second take-up pulley, said tension rod being structured for movement between a first tensioned position whereby said tension rod presses against said at least one cord and a second relaxed position whereby said tension rod and said at least one cord are not in contact with one another.

11. A swimming exercise and training apparatus comprising:

a flotation member sized and shaped to be positioned against a portion of a person's upper torso, said flotation member be constructed of a material capable of buoyantly resting on the surface of a body of water with said person thereon;

means for removably securing said flotation member to said portion of said person's upper torso;

at least one cord having a first end attached to said flotation member and an opposite second end structured for attachment to a generally stationary object, said at least one cord being structured to retain said flotation member substantially in place; and means for varying resistance on said at least one cord comprising a first pulley at a first end of said flotation member, a second take-up pulley within said flotation member and a tension rod disposed between said first pulley and said second take-up pulley, said at least one cord extending through said flotation member, around said first pulley and onto said second take-up pulley, said tension rod being structured for movement between a first tensioned position whereby said tension rod presses against said at least one cord and a second relaxed position whereby said tension rod and said at least one cord are not in contact with one another.

12. A swimming exercise and training apparatus as recited in claim 11 wherein said means for removably securing said flotation member to said portion of said person's upper torso comprises at least one strap structured to extend around said portion of said person's upper torso and having opposite ends structured for attachment to said flotation member.

13. A swimming exercise and training apparatus as recited in claim 11 further comprising at least one suction cup, each of said at least one suction cups being attached to said second end of said at least one cord and being structured for removable attachment to a stationary surface.

14. A swimming exercise and training apparatus as recited in claim 11 further comprising at least one stake member, each of said at least one stake members being attached to said second end of said at least one cord and being structured for removable attachment to a stationary surface.

15. A swimming exercise and training apparatus as recited in claim 14 wherein each of said at least one stake members includes an upper portion with a generally flat surface, said generally flat surface being structured to facilitate the exertion of force thereon so as to push said at least one stake member into said stationary surface.

16. A swimming exercise and training apparatus as recited in claim 15 wherein each of said at least one stake members includes a lower portion with a hook, said hook being structured to engage ragged surfaces so as to secure said at least one stake member thereto.

17. A swimming exercise and training apparatus as recited in claim 15 further comprising a swivel secured to said upper portion of said at least one stake member and attached to said second end of said at least one cord, said swivel being structured to allow said at least one cord to pivot around said at least one stake member in a generally horizontal plane.

* * * * *